US008851706B2

(12) United States Patent
Alsaffar

(10) Patent No.: US 8,851,706 B2
(45) Date of Patent: Oct. 7, 2014

(54) LIGHTED ROAD CONE

(71) Applicant: Abdulreidha Abdulrasoul Alsaffar, Mubarak Alkabeer (KW)

(72) Inventor: Abdulreidha Abdulrasoul Alsaffar, Mubarak Alkabeer (KW)

( * ) Notice: Subject to any disclaimer, the term of this patent is extended or adjusted under 35 U.S.C. 154(b) by 208 days.

(21) Appl. No.: 13/649,990

(22) Filed: Oct. 11, 2012

(65) Prior Publication Data

US 2014/0104833 A1 Apr. 17, 2014

(51) Int. Cl.
*F21V 21/00* (2006.01)

(52) U.S. Cl.
USPC ..... 362/249.01; 362/190; 362/191

(58) Field of Classification Search
USPC ..... 362/249.01, 190, 191
See application file for complete search history.

(56) References Cited

U.S. PATENT DOCUMENTS 2,094,741 A * 10/1937 Grussendorf et al. ..... 359/528
4,573,109 A 2/1986 Lack
8,602,584 B2 * 12/2013 Ghafoori et al. ..... 362/157
2009/0195412 A1 8/2009 Chen
2011/0210671 A1 9/2011 Nielson

FOREIGN PATENT DOCUMENTS

GB 2288659 10/1995
WO WO 8805583 7/1988

* cited by examiner

*Primary Examiner* — Vip Patel
(74) *Attorney, Agent, or Firm* — Richard C Litman

(57) ABSTRACT

The lighted road cone has a base and an elongate hollow pyramidal body having a plurality of faces extending upward from the base. A column of lights is disposed on each face of the pyramidal body, the lights extending from proximate the base upward to proximate a top portion of the hollow body. A controller turns the lights on and off. Preferably, each column has a pair of red lights near the base of the device, an intermediate pair of blue lights disposed upward from the red lights, and then a pair of red lights disposed upward from the blue lights. A top dome light may be disposed on the top of the hollow body. The lights may be prismatic in shape. Alternatively, the lights may be arranged in polygonal layers that circumscribe the pyramidal body.

12 Claims, 6 Drawing Sheets

LIGHTED ROAD CONE

BACKGROUND OF THE INVENTION

1. Field of the Invention

The present invention relates to a road cone, more particularly to a road cone including light emitting units for warning purposes.

2. Description of the Related Art

Traffic barriers and roadwork barriers are known in which horizontal rails are suspended between upright pots that carry electric lamps powered by electric batteries, for example, dry cell batteries. It is known to mount the lamps at the top of the posts, and the batteries may be inside the posts or external thereto. In either case, known arrangements provide the lamps in units that are separate from the batteries or from containers housing the batteries. Furthermore, experience has shown that the lamp units and batteries can be rather easily removed from the posts by thieves. Moreover, existing plastic cone design consists of a plastic material with a phosphorous dye to reflect its presence at lighted street use only. Dark, isolated streets have insufficient lighting to illuminate the existing plastic cone design in case of car breakdown or accident.

Thus, a lighted road cone solving the aforementioned problems is desired.

SUMMARY OF THE INVENTION

The lighted road cone comprises a pentagonal base and an elongate, hollow, pyramidal body extending therefrom. Each face of the pyramidal body has a column of lights extending from the base towards the top of the body. A controller turns the cone lights on and off. Each column of lights includes a pair of red lights near the base, an intermediate pair of blue lights, and then a pair of red lights disposed adjacent the top of the cone. A top dome light may be disposed on the top of the hollow pyramidal body.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
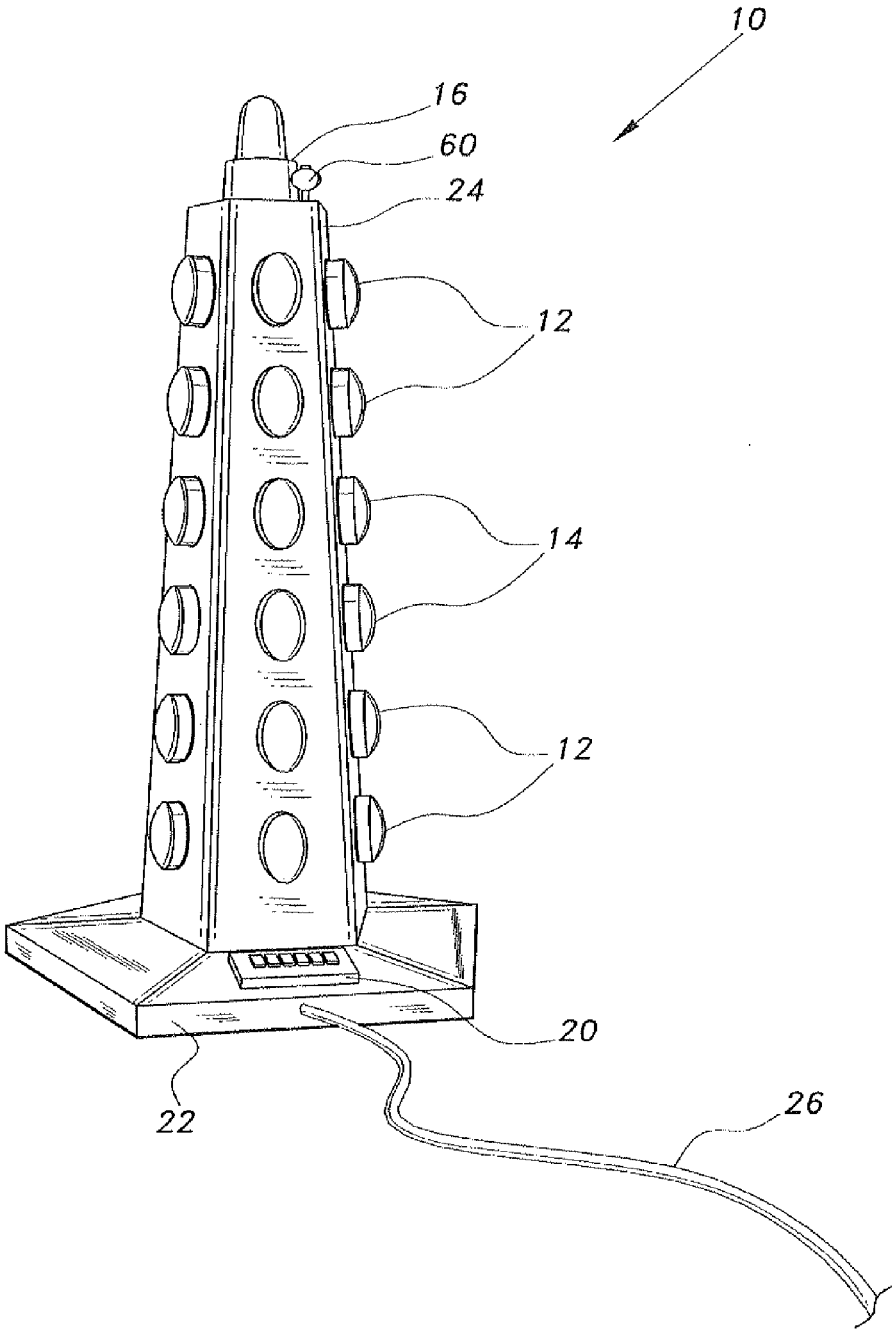
FIG. 1 is an environmental, perspective view of a lighted road cone according to the present invention.
Figure 2:
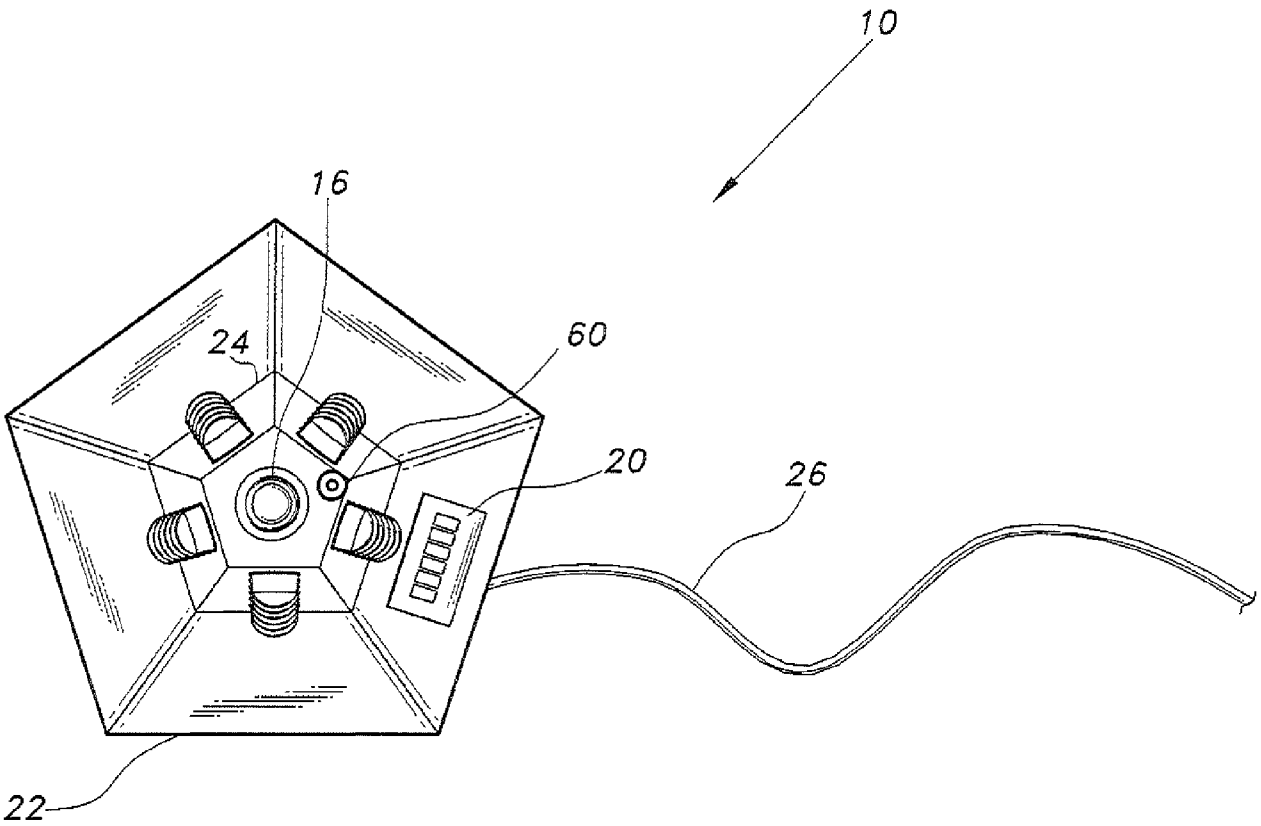
FIG. 2 is a top plan view of the lighted road cone of FIG. 1.

Referring to FIGS. 1-2, the lighted road cone 10 includes a pentagonal base 22 and an elongate, hollow, pyramidal body having faces 24. Each face 24 of the pyramidal body has a column of lights 12, 14 disposed thereon that extends from proximate the base 22 upward towards the top of the cone 10.

A controller 20 turns the lights 12, 14 on and off. A power cord 26 extends from the controller 20 to a power source for the lights 12, 14. Each column of lights 12, 14 comprises a pair of red lights 12 near the base of the cone 10, an intermediate pair of blue lights 14, and then a pair of red lights 12 disposed at the top of the column.

A top dome light 16 may be disposed on the top of the hollow body 24 and may use the same controller 20 for power control and flash rate control. The controller includes six switches for effecting control over the lights 12, 14, 16. The alternating pattern of lights may continue for the length of the hollow body 24. While a pyramid having a pentagonal base, and therefore five faces, is shown in the drawings, it will be understood that the cone 10 may have a pyramidal body having any number of faces and a base with a corresponding polygonal shape (e.g., triangular, square, hexagonal, etc.). It will also be understood that although the drawings show the columns of lights on each face of the cone 10 having six lights 12, 14 grouped in pairs, the cone faces 24 may have a column including any number of lights 12, 14, which may be grouped in other color patterns.

The lights 12, 14, 16 may be incandescent, neon, compact fluorescent, halogen, or Light Emitting Diodes (LEDs), and may include a translucent cover having the desired light color. Alternatively, the light pattern may comprise any combination of white lights, yellow lights, red lights, and blue lights. The power source may be alternating or direct current (AC or DC). Electronic circuitry in the controller 20 may turn the lights on, turn the lights off, and may also cause the lights to flash or strobe either simultaneously (i.e., turn all lights on and off simultaneously) or sequentially (e.g., flash all lights in a single column on and off simultaneously, then flash all lights in the second column of lights on and off simultaneously, etc., so that each face of the pyramidal cone is lighted sequentially in a 360° pattern) at an exemplary 10 Hz rate. A master key switch 60 may be used to energize or de-energize the entire unit 10. The device 10 may be broken down for storage in the trunk of a car.

Figure 3:
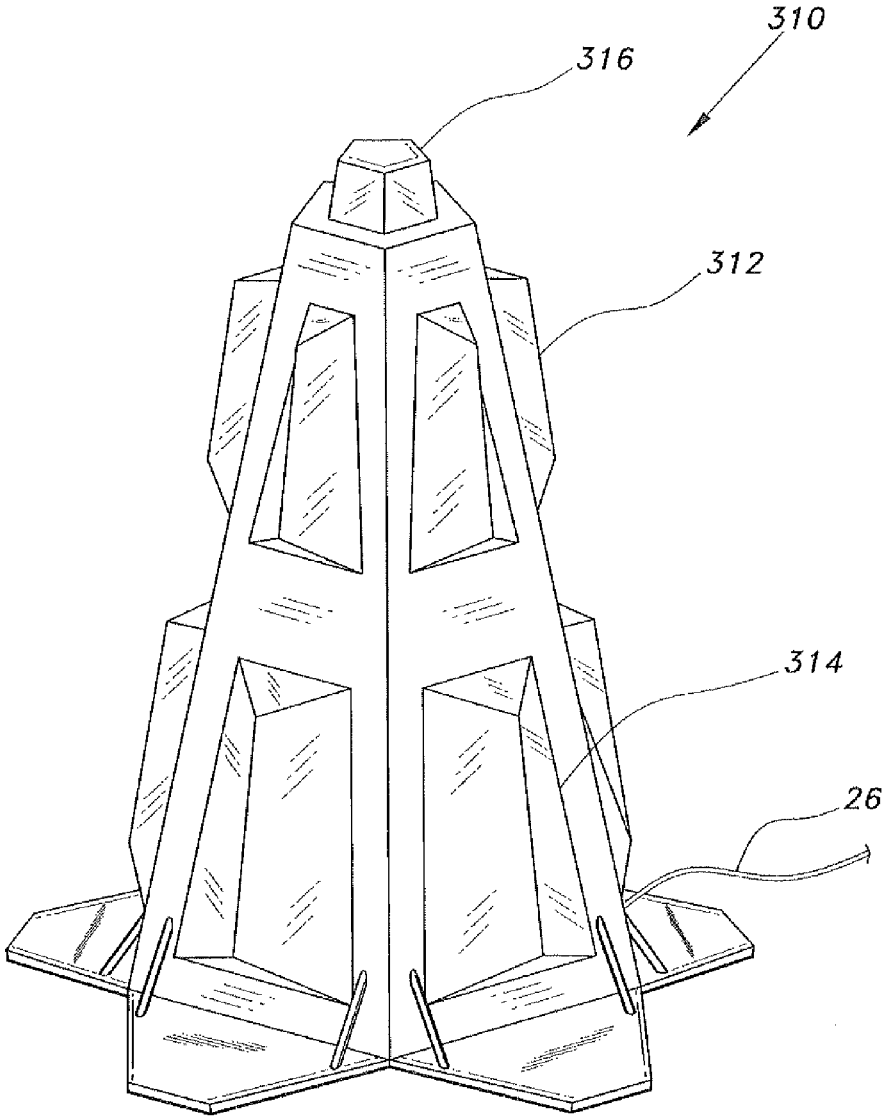
FIG. 3 is a perspective view of a first alternative embodiment of a lighted highway cone according to the present invention.
Figure 4:
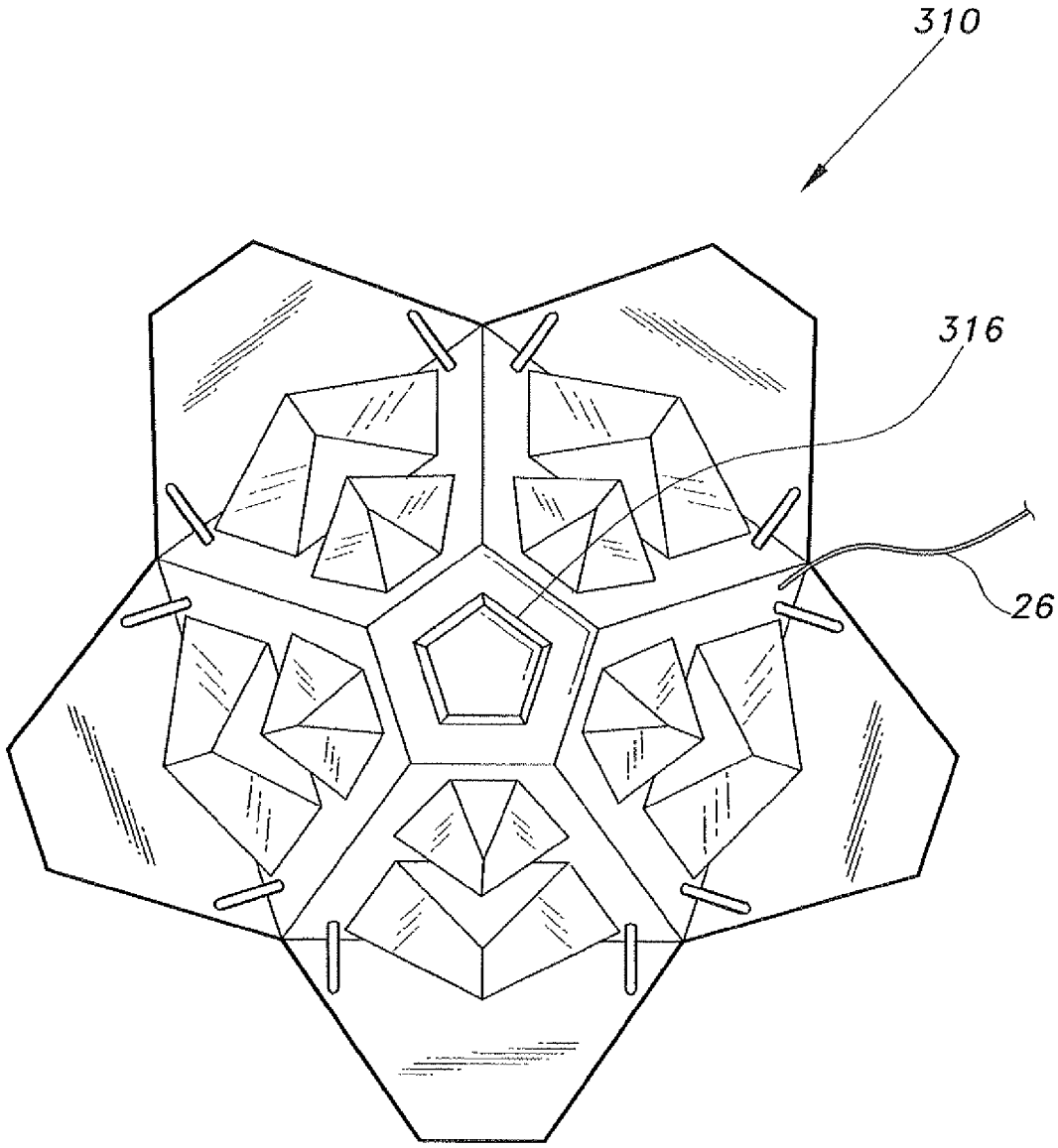
FIG. 4 is a top plan view of the lighted highway cone of FIG. 3.

In a first alternative embodiment, shown in FIGS. 3-4, the lighted road cone 310 has lights 312, 314 disposed in columns on the road cone sides. As with the cone 10 of FIGS. 1 and 2, the body of the cone 310 has five sides arranged in a pyramidal structure. However, the base of the cone 310 has discrete trapezoidal feet extending from the bottom of each face of the cone 310. The lower lights 314 are designed to have a different color than upper lights 312. A pentagonal dome light 316 is coaxially disposed at the very top of the lighted road cone 310. The lights 312, 314 are elongated, prismatic members.

Figure 5:
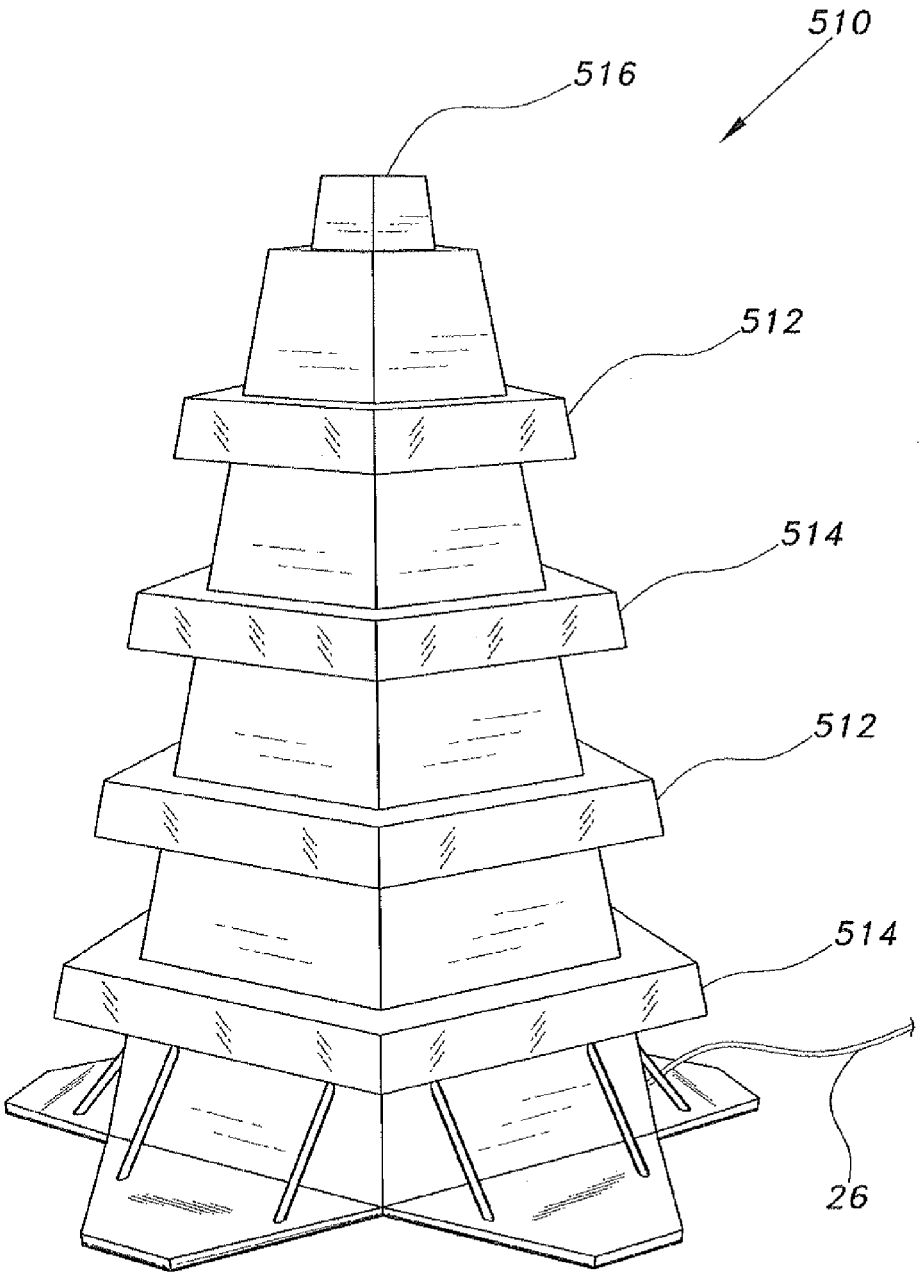
FIG. 5 is a perspective view of a second alternative embodiment of a lighted highway cone according to the present invention.
Figure 6:
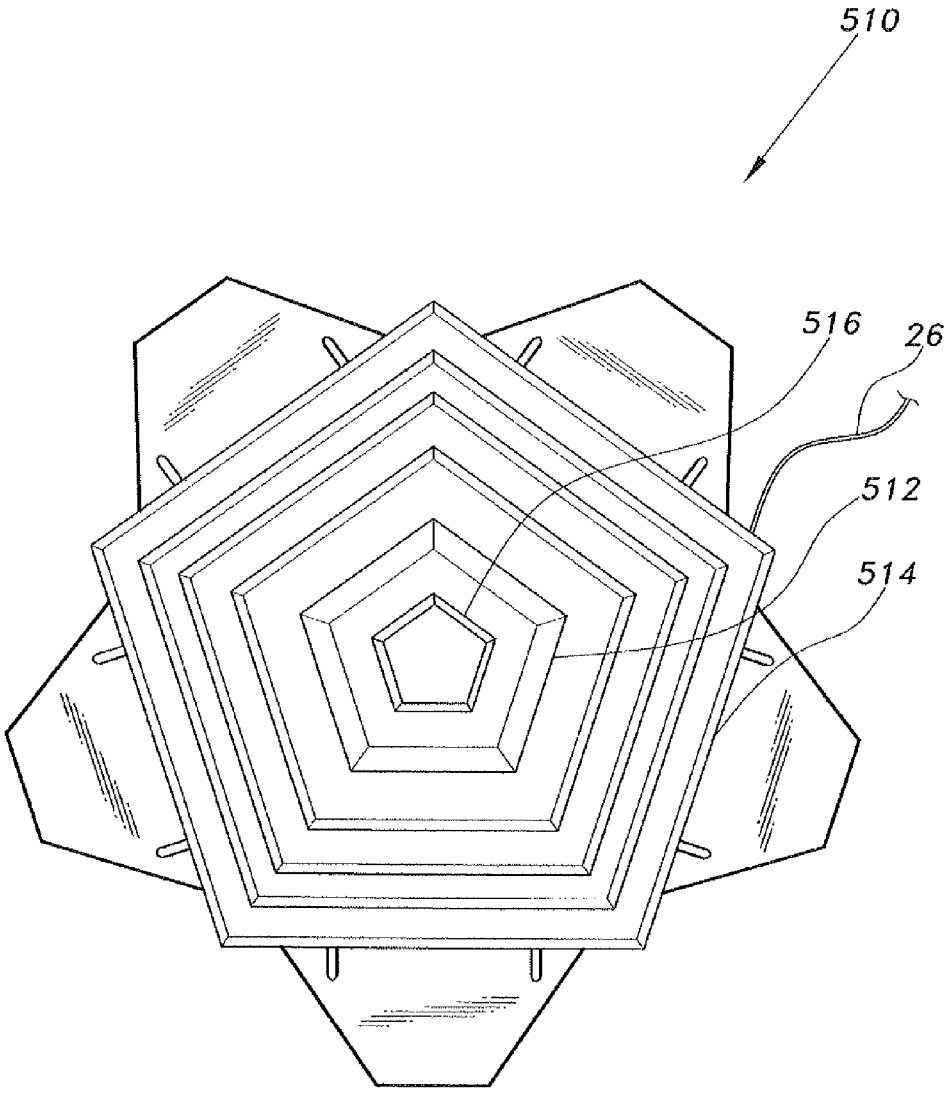
FIG. 6 is a top plan view of the lighted highway cone of FIG. 5.

In a second alternative embodiment, shown in FIGS. 5-6, the lighted road cone 510 has lights 512, 514 which circumscribe the road cone sides in layers. As with the embodiment of FIGS. 3-4, the body of the cone 510 has five sides or faces arranged in a pryamidal structure, and the base comprises five discrete trapezoids extending from the bottom of the faces. However, in this embodiment, the lights 512, 514 are pentagonal structures that extend outward from the faces of the cone 510 and encircle the cone 510. The lights 514 and 512 are designed to have different colors from each other. A pentagonal dome light 516 is coaxially disposed at the very top of the lighted road cone 510.

It is to be understood that the present invention is not limited to the embodiments described above, but encompasses any and all embodiments within the scope of the following claims.

I claim:

1. A lighted road cone, comprising:

a base;

a hollow housing extending from the base, the housing having a top portion;

a pattern of electrical lights disposed on the housing and extending from proximate the base to proximate the top portion of the housing;

a control panel including an electronic circuit for controlling actuation and a blink pattern of the lights; and a power cable extending from the control panel, the power cable being adapted to receive power from a power source to energize the lights.

2. The lighted road cone according to claim 1, wherein said base is polygonal and said housing is pyramidal, the housing having a plurality of faces.

3. The lighted road cone according to claim 2, wherein said base is pentagonal, said housing having five faces.

4. The lighted road cone according to claim 2, wherein said pattern of lights comprises a column of lights on each of the faces of said pyramidal housing.

5. The lighted road cone according to claim 4, wherein each said column of lights includes:

a first pair of red lights disposed on the face near the base;

an intermediate pair of blue lights disposed on the face above the first pair of red lights; and a second pair of red lights disposed on the face above the intermediate pair of blue lights.

6. The lighted road cone according to claim 2, further comprising a master key power switch disposed on the top portion of said housing.

7. The lighted road cone according to claim 2, further comprising a dome light sitting atop the top portion of said housing.

8. The lighted road cone according to claim 2, wherein the blink pattern comprises flashing all of said lights on and off simultaneously.

9. The lighted road cone according to claim 2, wherein said pattern of lights comprises a column of lights on each of the faces of said pyramidal housing, the blink pattern comprising flashing the columns of lights on and off sequentially.

10. The lighted road cone according to claim 1, wherein said housing comprises five planar faces joined together to form a pentagonal pyramid, said base comprising a trapezoidal member extending from a bottom edge of each of the faces.

11. The lighted road cone according to claim 10, wherein said electrical lights comprise a plurality of pentagonal lights circumscribing said housing, the lights being spaced apart from the base to the top portion of said housing.

12. The lighted road cone according to claim 10, wherein each of said electrical lights comprises an elongated, prismatic member, the lights being spaced apart from the base to the top portion of said housing.

* * * * *